US011855343B2

(12) United States Patent
Yu et al.

(10) Patent No.: US 11,855,343 B2
(45) Date of Patent: Dec. 26, 2023

(54) ANTENNA AND MOBILE TERMINAL

(71) Applicant: Beijing Kunshi Intellectual Property Management Co., Ltd., Beijing (CN)

(72) Inventors: Dong Yu, Shanghai (CN); Hanyang Wang, Reading (GB); Jianming Li, Shenzhen (CN)

(73) Assignee: Beijing Kunshi Intellectual Property Management Co., Ltd., Beijing (CN)

( * ) Notice: Subject to any disclaimer, the term of this patent is extended or adjusted under 35 U.S.C. 154(b) by 0 days.

(21) Appl. No.: 17/815,497

(22) Filed: Jul. 27, 2022

(65) Prior Publication Data

US 2022/0368010 A1 Nov. 17, 2022

Related U.S. Application Data

(63) Continuation of application No. 17/087,090, filed on Nov. 2, 2020, now Pat. No. 11,431,088, which is a (Continued)

(30) Foreign Application Priority Data

Feb. 12, 2014 (CN) ..... 201410049186.X

(51) Int. Cl.
*H01Q 5/10* (2015.01)
*H01Q 1/38* (2006.01)

(Continued)

(52) U.S. Cl.
CPC ..... *H01Q 1/38* (2013.01); *H01Q 1/243* (2013.01); *H01Q 1/48* (2013.01); *H01Q 5/328* (2015.01);

(Continued)

(58) Field of Classification Search
CPC ..... H01Q 1/38; H01Q 1/243; H01Q 1/48; H01Q 5/328; H01Q 5/335; H01Q 5/371; H01Q 5/378; H01Q 7/00; H01Q 9/42
See application file for complete search history.

(56) References Cited

U.S. PATENT DOCUMENTS 7,764,232 B2 * 7/2010 Achour ..... H01Q 15/0086 343/909
2002/0019247 A1 2/2002 Egorov (Continued)

FOREIGN PATENT DOCUMENTS

CN 1805215 A 7/2006
CN 101127513 A 2/2008

(Continued)

OTHER PUBLICATIONS

Chen, W., "Research on Novel Multiband and Compact Antenna Based on Composite Right/Left-Handed Transmission Lines Structures," Dissertation Submitted for the Degree of Doctor of Philosophy, South China University of Technology, Guangzhou, China, Dec. 15, 2012, 129 pages.

(Continued)

*Primary Examiner* — Hai V Tran
*Assistant Examiner* — Bamidele A Immanuel
(74) *Attorney, Agent, or Firm* — Slater Matsil, LLP

(57) ABSTRACT

An antenna includes a first radiator and a first capacitor structure. A first end of the first radiator is electrically connected to a signal feed end of a printed circuit board by means of the first capacitor structure, and a second end of the first radiator is electrically connected to a ground end of the printed circuit board. The first radiator, the first capacitor structure, the signal feed end, and the ground end form a first antenna configured to produce a first resonance frequency. An electrical length of the first radiator is greater than one eighth of a wavelength corresponding to the first resonance (Continued)

frequency, and the electrical length of the first radiator is less than a quarter of the wavelength corresponding to the first resonance frequency.

20 Claims, 14 Drawing Sheets

Related U.S. Application Data continuation of application No. 16/526,450, filed on Jul. 30, 2019, now Pat. No. 10,826,170, which is a continuation of application No. 15/112,635, filed as application No. PCT/CN2015/072406 on Feb. 6, 2015, now Pat. No. 10,403,971.

(51) Int. Cl.

| | |
|---|---|
| ***H01Q 7/00*** | (2006.01) |
| ***H01Q 9/42*** | (2006.01) |
| ***H01Q 5/335*** | (2015.01) |
| ***H01Q 5/328*** | (2015.01) |
| ***H01Q 5/371*** | (2015.01) |
| ***H01Q 5/378*** | (2015.01) |
| ***H01Q 1/24*** | (2006.01) |
| ***H01Q 1/48*** | (2006.01) |

(52) U.S. Cl.

CPC ..... *H01Q 5/335* (2015.01); *H01Q 5/371* (2015.01); *H01Q 5/378* (2015.01); *H01Q 7/00* (2013.01); *H01Q 9/42* (2013.01)

(56) References Cited

U.S. PATENT DOCUMENTS

| | | | | |
|---|---|---|---|---|
| 2004/0085245 | A1 | 5/2004 | Miyata et al. | |
| 2004/0212545 | A1 | 10/2004 | Li et al. | |
| 2005/0168384 | A1 | 8/2005 | Wang et al. | |
| 2006/0152419 | A1* | 7/2006 | Sato | H01Q 9/42 343/702 |
| 2007/0069958 | A1 | 3/2007 | Ozkar | |
| 2008/0106473 | A1 | 5/2008 | Chung et al. | |
| 2008/0258992 | A1 | 10/2008 | Tsai et al. | |
| 2008/0278398 | A1 | 11/2008 | Tsai et al. | |
| 2009/0033558 | A1 | 2/2009 | Chung | |
| 2009/0203338 | A1 | 8/2009 | Darabi | |
| 2009/0237309 | A1* | 9/2009 | Ohba | H01Q 1/38 343/893 |
| 2009/0278755 | A1* | 11/2009 | Shoji | H01Q 5/335 343/745 |
| 2010/0048266 | A1* | 2/2010 | Maruyama | H01Q 9/40 343/702 |
| 2010/0060528 | A1 | 3/2010 | Chiu et al. | |
| 2010/0073254 | A1 | 3/2010 | Lee et al. | |
| 2010/0271271 | A1 | 10/2010 | Wu | |
| 2010/0302114 | A1 | 12/2010 | Kaikkonen et al. | |
| 2011/0102290 | A1 | 5/2011 | Milosavljevic | |
| 2011/0109512 | A1* | 5/2011 | Onaka | H01Q 5/392 343/700 MS |
| 2011/0133994 | A1 | 6/2011 | Korva | |
| 2011/0267246 | A1 | 11/2011 | Tseng et al. | |
| 2012/0001818 | A1 | 1/2012 | Lee et al. | |
| 2012/0007782 | A1* | 1/2012 | Nishio | H01Q 5/371 343/700 MS |
| 2012/0056788 | A1* | 3/2012 | Ryou | H01Q 15/0086 343/700 MS |
| 2012/0105286 | A1* | 5/2012 | Rhyu | H01Q 9/0421 343/702 |
| 2012/0105292 | A1 | 5/2012 | Wong et al. | |
| 2012/0146865 | A1* | 6/2012 | Hayashi | H01Q 5/392 343/750 |
| 2012/0182186 | A1* | 7/2012 | Yang | H01Q 9/42 343/700 MS |
| 2012/0223866 | A1 | 9/2012 | Ayala Vazquez et al. | |
| 2012/0223869 | A1* | 9/2012 | Kim | H01Q 9/0442 343/769 |
| 2012/0242555 | A1* | 9/2012 | Hsieh | H01Q 5/378 343/860 |
| 2012/0287014 | A1* | 11/2012 | Tseng | H01Q 5/321 343/876 |
| 2012/0313830 | A1 | 12/2012 | Lee | |
| 2013/0038494 | A1 | 2/2013 | Kuonanoja | |
| 2013/0044036 | A1* | 2/2013 | Kuonanoja | H01Q 5/371 343/893 |
| 2013/0050036 | A1* | 2/2013 | Kashiwagi | H01Q 5/10 343/749 |
| 2013/0201067 | A1 | 8/2013 | Hu et al. | |
| 2015/0155616 | A1 | 6/2015 | Lin | |
| 2016/0248146 | A1 | 8/2016 | Wang et al. | |
| 2018/0366814 | A1 | 12/2018 | Li et al. | |

FOREIGN PATENT DOCUMENTS

| | | | | |
|---|---|---|---|---|
| CN | 101174730 | A | 5/2008 | |
| CN | 101582533 | A | 11/2009 | |
| CN | 101809813 | A | 8/2010 | |
| CN | 102104199 | A | 6/2011 | |
| CN | 102468533 | A | 5/2012 | |
| CN | 103367885 | A | 10/2013 | |
| CN | 104836034 | A | 8/2015 | |
| EP | 2448062 | A2 | 5/2012 | |
| EP | 3091609 | A1 | 11/2016 | |
| KR | 20110060389 | A * | 11/2009 | H01Q 13/08 |
| KR | 20110060389 | A | 6/2011 | |
| KR | 20120134818 | A * | 6/2011 | H01Q 1/24 |
| KR | 20120134818 | A | 12/2012 | |
| TW | 201251204 | A | 12/2012 | |
| WO | 2010101373 | A2 | 9/2010 | |
| WO | 2010107211 | A2 | 9/2010 | |
| WO | WO-2010101373 | A2 * | 9/2010 | H01Q 1/38 |
| WO | WO-2010107211 | A2 * | 9/2010 | H01Q 15/0086 |
| WO | 2010117177 | A2 | 10/2010 | |
| WO | WO-2010117177 | A2 * | 10/2010 | H01Q 15/0086 |
| WO | 2011024575 | A1 | 3/2011 | |
| WO | WO-2011024575 | A1 * | 3/2011 | H01Q 1/38 |
| WO | 2015143714 | A1 | 10/2015 | |

OTHER PUBLICATIONS

Withayachumnankul, W. et al., "Compact Electric-LC Resonators for Metamaterials," Optical Society of America, Dec. 6, 2010/vol. 18, No. 25/Optics Expresss, pp. 25912-25921.

Zhu, J. et al., "A Compact Tri-Band Monopole Antenna With Single-Cell Metamaterial Loading", IEEE Transactions on Antennas and Propagation, vol. 58, No. 4, Apr. 2010, pp. 1031-1038.

Schüßler, M. et al., "Design of Compact Planar Antennas using LH-Transmission Lines", 2004 IEEE MIT-S International Microwave Symposium Digest, IEEE Cat. No. 04CH37535, Jun. 6-11, 2004, pp. 209-212.

* cited by examiner

ANTENNA AND MOBILE TERMINAL

CROSS-REFERENCE TO RELATED APPLICATIONS

This application is a continuation of U.S. patent application Ser. No. 17/087,090, filed on Nov. 2, 2020, which is a continuation of U.S. patent application Ser. No. 16/526,450, filed on Jul. 30, 2019, now U.S. Pat. No. 10,826,170, which is a continuation of U.S. patent application Ser. No. 15/112,635, filed on Jul. 19, 2016, now U.S. Pat. No. 10,403,971, which is a national stage of International Application No. PCT/CN2015/072406, filed on Feb. 6, 2015, which claims priority to Chinese Patent Application No. 201410049186.X, filed on Feb. 12, 2014. All of the aforementioned patent applications are hereby incorporated by reference in their entireties.

TECHNICAL FIELD

The present invention relates to the field of antenna technologies, and in particular, to an antenna and a mobile terminal.

BACKGROUND

An antenna is an apparatus used in a radio device to receive and transmit an electromagnetic wave signal. As the fourth generation mobile communication comes, there is an increasingly high requirement for a bandwidth of a terminal product. Currently, industrial design (ID for short) of an existing mobile terminal is increasingly compact, causing design space of an antenna to be increasingly small, and moreover, an antenna of a mobile terminal also needs to cover more frequency bands and types. Therefore, miniaturization and broadbandization of the antenna of the mobile terminal have become an inevitable trend.

In an antenna design solution of the existing mobile terminal, such as a printed circuit board invert F antenna (PIFA antenna), an invert F antenna (IFA), a monopole antenna, a T-shape antenna, or a loop antenna, only when an electrical length of the foregoing existing antenna at least needs to meet a quarter to a half of a low-frequency wavelength, can both low-frequency and wide-frequency resonance frequencies be produced. Therefore, it is very difficult to meet a condition that both a low frequency and a wide frequency are covered in a small-sized space environment.

SUMMARY

Embodiments of the present invention provide an antenna and a mobile terminal, so as to implement design of an antenna with multiple resonance frequencies within relatively small space.

Technical solutions used in the embodiments of the present invention are as follows.

According to a first aspect, an embodiment of the present invention provides an antenna, including a first radiator and a first capacitor structure, where a first end of the first radiator is electrically connected to a signal feed end of a printed circuit board by means of the first capacitor structure, and a second end of the first radiator is electrically connected to a ground end of the printed circuit board. The first radiator, the first capacitor structure, the signal feed end, and the ground end form a first antenna configured to produce a first resonance frequency. An electrical length of the first radiator is greater than one eighth of a wavelength corresponding to the first resonance frequency, and the electrical length of the first radiator is less than a quarter of the wavelength corresponding to the first resonance frequency.

With reference to the first aspect, in a first possible implementation manner, a second end of the first radiator being electrically connected to a ground end of the printed circuit board is specifically: the second end of the first radiator being electrically connected to the ground end of the printed circuit board by means of a second capacitor structure.

With reference to the first aspect or the first possible implementation manner of the first aspect, in a second possible implementation manner, the antenna further includes a second radiator, where a first end of the second radiator is electrically connected to the first end of the first radiator, and the second radiator, the first capacitor structure, and the signal feed end form a second antenna configured to produce a second resonance frequency.

With reference to the second possible implementation manner of the first aspect, in a third possible implementation manner, the antenna further includes a parasitic branch, where one end of the parasitic branch is electrically connected to the ground end of the printed circuit board, and another end of the parasitic branch and a second end of the second radiator are opposite and do not contact each other, so as to form coupling and produce a third resonance frequency.

With reference to the first aspect, the first possible implementation manner of the first aspect, the second possible implementation manner of the first aspect, or the third possible implementation manner of the first aspect, in a fourth possible implementation manner, the first capacitor structure includes an E-shape component and a U-shape component, where the E-shape component includes: the E-shape component includes a first branch, a second branch, a third branch, and a fourth branch, where the first branch and the third branch are connected to two ends of the fourth branch, the second branch is located between the first branch and the third branch, the second branch is connected to the fourth branch, there is a gap formed between the first branch and the second branch, and there is a gap formed between the second branch and the third branch; and the U-shape component includes two branches, where the two branches of the U-shape component are separately located in the two gaps of the E-shape component, and the E-shape component and the U-shape component do not contact each other.

With reference to the fourth possible implementation manner of the first aspect, in a fifth possible implementation manner, the first end of the first radiator is connected to the first branch of the first capacitor structure, or the first end of the first radiator is connected to the fourth branch of the first capacitor structure.

With reference to the second possible implementation manner of the first aspect, in a sixth possible implementation manner, the second radiator is located on an extension cord of the first radiator.

With reference to the fourth possible implementation manner of the first aspect, in a seventh possible implementation manner, the first end of the second radiator is connected to the third branch of the first capacitor structure.

With reference to the first possible implementation manner of the first aspect, in an eighth possible implementation manner, the second capacitor structure includes an E-shape component and a U-shape component, where the E-shape component includes: the E-shape component includes a first branch, a second branch, a third branch, and a fourth branch, where the first branch and the third branch are connected to two ends of the fourth branch, the second branch is located between the first branch and the third branch, the second branch is connected to the fourth branch, there is a gap formed between the first branch and the second branch, and there is a gap formed between the second branch and the third branch; and the U-shape component includes two branches, where the two branches of the U-shape component are separately located in the two gaps of the E-shape component, and the E-shape component and the U-shape component do not contact each other.

With reference to any one of the first aspect to the eighth possible implementation manner of the first aspect, in a ninth possible implementation manner, the first radiator is located on an antenna support, and a vertical distance between a plane on which the first radiator is located and a plane on which the printed circuit board is located is between 2 millimeters and 6 millimeters.

According to a second aspect, an embodiment of the present invention provides a mobile terminal, including a radio frequency processing unit, a baseband processing unit, and an antenna. The antenna includes a first radiator and a first capacitor structure, where a first end of the first radiator is electrically connected to a signal feed end of the printed circuit board by means of the first capacitor structure, and a second end of the first radiator is electrically connected to a ground end of the printed circuit board; the first radiator, the first capacitor structure, the signal feed end, and the ground end form a first antenna configured to produce a first resonance frequency; and an electrical length of the first radiator is greater than one eighth of a wavelength corresponding to the first resonance frequency, and the electrical length of the first radiator is less than a quarter of the wavelength corresponding to the first resonance frequency. The radio frequency processing unit is electrically connected to the signal feed end of the printed circuit board by means of a matching circuit. The antenna is configured to transmit a received radio signal to the radio frequency processing unit, or convert a transmit signal of the radio frequency processing unit into an electromagnetic wave and send the electromagnetic wave; the radio frequency processing unit is configured to perform frequency-selective, amplifying, and down-conversion processing on the radio signal received by the antenna, and convert the processed radio signal into an intermediate frequency signal or a baseband signal and send the intermediate frequency signal or the baseband signal to the baseband processing unit, or configured to send, by means of the antenna and by means of up-conversion and amplifying, a baseband signal or an intermediate frequency signal sent by the baseband processing unit; and the baseband processing unit processes the received intermediate frequency signal or baseband signal.

With reference to the second aspect, in a first possible implementation manner, a second end of the first radiator being electrically connected to a ground end of the printed circuit board is specifically: the second end of the first radiator being electrically connected to the ground end of the printed circuit board by means of a second capacitor structure.

With reference to the second aspect or the first possible implementation manner of the second aspect, in a second possible implementation manner, the antenna further includes a second radiator, where a first end of the second radiator is electrically connected to the first end of the first radiator, and the second radiator, the first capacitor structure, and the signal feed end form a second antenna configured to produce a second resonance frequency.

With reference to the second possible implementation manner of the second aspect, in a third possible implementation manner, the antenna further includes a parasitic branch, where one end of the parasitic branch is electrically connected to the ground end of the printed circuit board, and another end of the parasitic branch and a second end of the second radiator are opposite and do not contact each other, so as to form coupling and produce a third resonance frequency.

With reference to any one of the second aspect to the foregoing three possible implementation manners of the second aspect, in a fourth possible implementation manner, the first radiator is located on an antenna support, and a vertical distance between a plane on which the first radiator is located and a plane on which the printed circuit board is located is between 2 millimeters and 6 millimeters.

The embodiments of the present invention provide an antenna and a mobile terminal, where the antenna includes a first radiator and a first capacitor structure, where a first end of the first radiator is electrically connected to a signal feed end of the printed circuit board by means of the first capacitor structure, and a second end of the first radiator is electrically connected to a ground end of the printed circuit board; the first radiator, the first capacitor structure, the signal feed end, and the ground end form a first antenna configured to produce a first resonance frequency; and an electrical length of the first radiator is greater than one eighth of a wavelength corresponding to the first resonance frequency, and the electrical length of the first radiator is less than a quarter of the wavelength corresponding to the first resonance frequency, so as to implement design of an antenna with multiple resonance frequencies within relatively small space.

BRIEF DESCRIPTION OF THE DRAWINGS

To describe the technical solutions in the embodiments of the present invention more clearly, the following briefly describes the accompanying drawings required for describing the embodiments. Apparently, the accompanying drawings in the following description show merely some embodiments of the present invention, and a person of ordinary skill in the art may still derive other drawings from these accompanying drawings without creative efforts.

DETAILED DESCRIPTION OF ILLUSTRATIVE EMBODIMENTS

Figure 1:
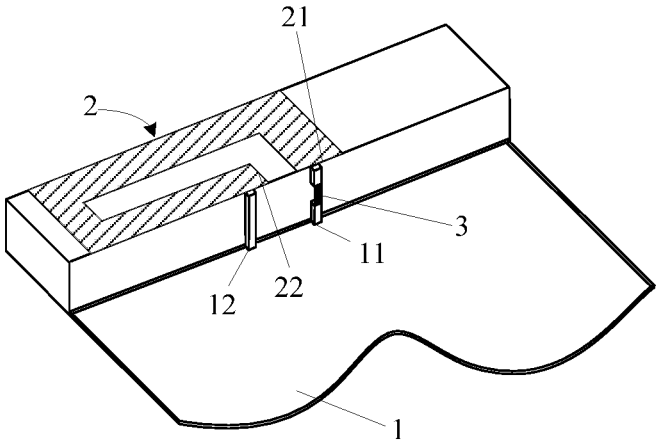
FIG. 1 is a schematic diagram 1 of an antenna according to an embodiment of the present invention.

The following clearly and completely describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

Embodiment 1

This embodiment of the present invention provides an antenna, including a first radiator 2 and a first capacitor structure 3, where a first end 21 of the first radiator 2 is electrically connected to a signal feed end 11 of a printed circuit board 1 by means of the first capacitor structure 3, and a second end 22 of the first radiator 2 is electrically connected to a ground end 12 of the printed circuit board 1; the first radiator 2, the first capacitor structure 3, the signal feed end 11, and the ground end 12 form a first antenna P1 configured to produce a first resonance frequency f1; and an electrical length of the first radiator 2 is greater than one eighth of a wavelength corresponding to the first resonance frequency f1, and the electrical length of the first radiator 2 is less than a quarter of the wavelength corresponding to the first resonance frequency f1.

Figure 2:
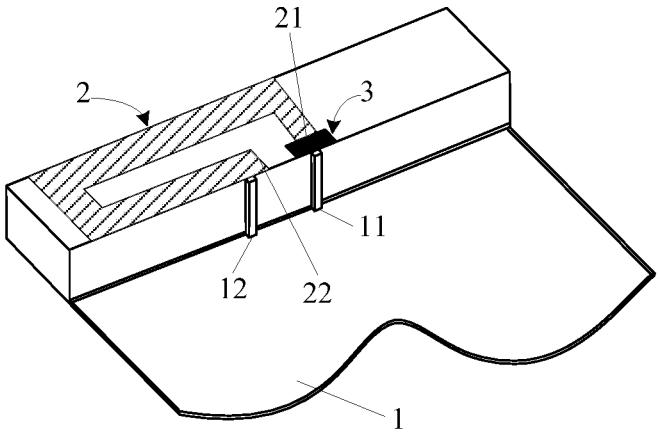
FIG. 2 is a schematic diagram 2 of an antenna according to an embodiment of the present invention.

In actual design, different design positions of the first capacitor structure 3 may provide different schematic diagrams of the antenna. As shown in FIG. 1, a slant part is the first radiator 2, and a black part is the first capacitor structure 3. As shown in FIG. 2, a slant part is the first radiator 2, and a black part is the first capacitor structure 3. The antennas in FIG. 1 and FIG. 2 are both configured to produce the first resonance frequency f1, and only differ in a position of the first capacitor structure 3.

Figure 3:
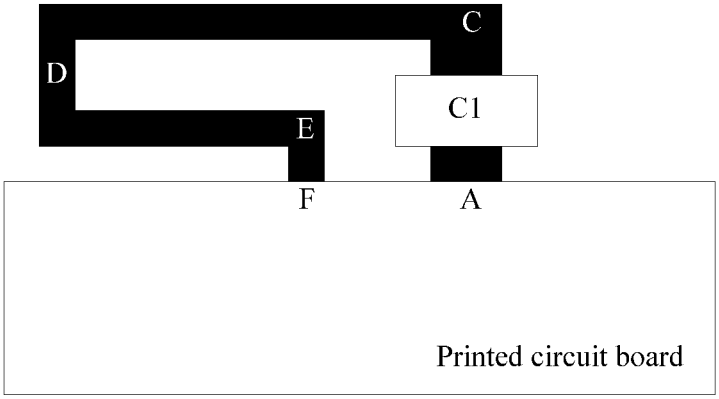
FIG. 3 is a schematic plane diagram of the antennas shown in the schematic diagram 1 and schematic diagram 2 according to an embodiment of the present invention.

To help understand how the antennas produce the first resonance frequency f1, FIG. 3 is a schematic plane diagram of the antenna in FIGS. 1. A, C, D, E, and F shown in a black part in FIG. 3 represent the first radiator 2, C1 represents the first capacitor structure 3, and a white part represents the printed circuit board 1. A part connected to A is the signal feed end 11 of the printed circuit board 1, and a part connected to F is the ground end 12 of the printed circuit board 1.

Figure 4:
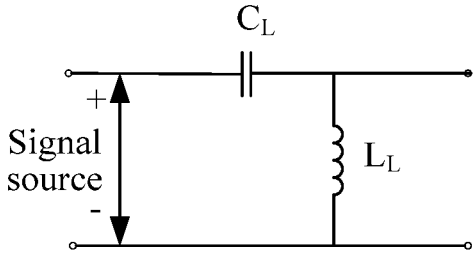
FIG. 4 is a schematic diagram of an equivalent circuit of the antennas shown in the schematic diagram 1 and schematic diagram 2 according to an embodiment of the present invention.

Specifically, the first radiator 2, the first capacitor structure 3, the signal feed end 11, and the ground end 12 form the first antenna P1, and a diagram of an equivalent circuit of the first antenna is shown in FIG. 4 and conforms to a left hand transmission line structure. The first radiator 2 is equivalent to a shunt inductor LL relative to a signal source, and the first capacitor structure 3 is equivalent to a serially connected capacitor CL relative to the signal source, so as to produce the first resonance frequency f1. The first resonance frequency f1 may cover 791 MHz to 821 MHz, GSM850 (824 MHz to 894 MHz), or GSM900 (880 MHz to 960 MHz).

Generally, an effective length of an antenna (that is, an electrical length of the antenna) is represented by using multiples of a wavelength corresponding to a resonance frequency produced by the antenna, and an electrical length of the first radiator in this embodiment is a length represented by A-C-D-E-F shown in FIG. 3.

Further, because the electrical length of the first radiator 2 is greater than one eighth of the wavelength corresponding to the first resonance frequency f1, and the electrical length of the first radiator 2 is less than a quarter of the wavelength corresponding to the first resonance frequency f1, the first antenna P1 further produces a high-order harmonic wave of the first resonance frequency f1 (which is also referred to as frequency multiplication of the first resonance frequency f1), where coverage of the high-order harmonic wave is 1700 MHz to 1800 MHz. Therefore, the first radiator 2, the first capacitor structure 3, the signal feed end 11, and the ground end 12 form the first antenna P1, so that a frequency range covering the first resonance frequency f1 and the high-order harmonic wave of the first resonance frequency f1 can be produced within relatively small space.

Figure 5:
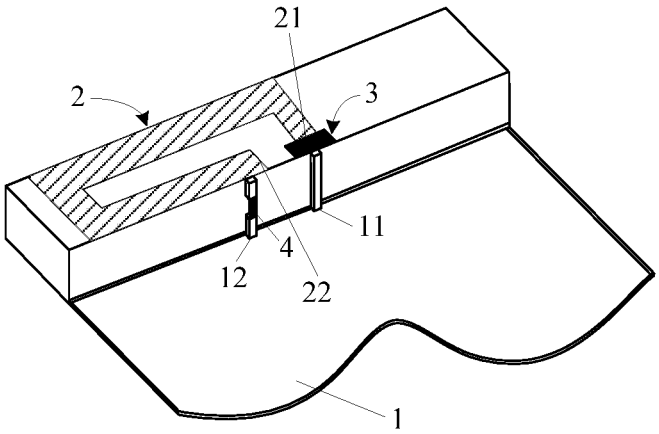
FIG. 5 is a schematic diagram 3 of an antenna according to an embodiment of the present invention.

Further, as shown in FIG. 5, a second end 22 of the first radiator 2 being electrically connected to a ground end 12 of the printed circuit board 1 is specifically: the second end 22 of the first radiator 2 being electrically connected to the ground end 12 of the printed circuit board 1 by means of a second capacitor structure 4.

Specifically, the second end 22 of the first radiator 2 is electrically connected to the ground end 12 of the printed circuit board 1 by means of the second capacitor structure 4, so that the first resonance frequency f1 produced by the first antenna P1 may be offset upward. By means of the feature, an inductance value of the shunt inductor may be increased (that is, the electrical length of the first radiator 2 is increased), so that in a case in which resonance of the first resonance frequency f1 remains unchanged, the high-order harmonic wave produced by the first resonance frequency f1 continues to be offset downward, thereby further widening a bandwidth of the high-order harmonic wave produced by the first resonance frequency f1.

Figure 6:
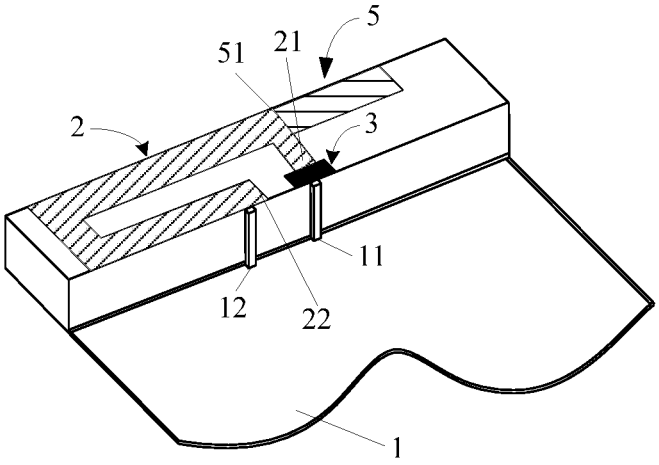
FIG. 6 is a schematic diagram 4 of an antenna according to an embodiment of the present invention.

Further, as shown in FIG. 6, the antenna further includes a second radiator 5, where a first end 51 of the second radiator 5 is electrically connected to the first end 21 of the first radiator 2, and the second radiator 5, the first capacitor structure 3, and the signal feed end 11 form a second antenna P2 configured to produce a second resonance frequency f2.

Optionally, the second radiator 5 is located on an extension cord of the first radiator 2.

Figure 7:
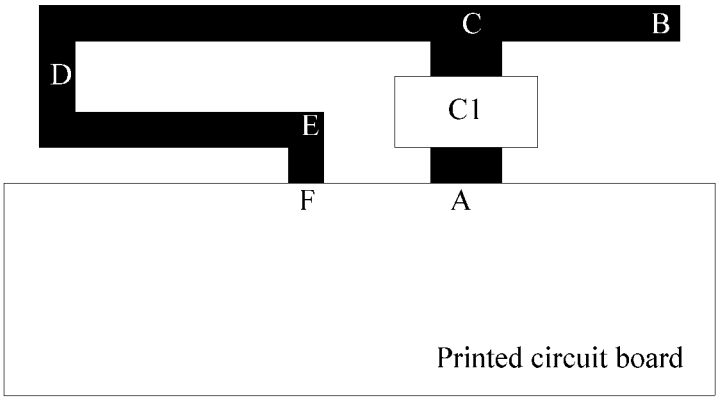
FIG. 7 is a schematic plane diagram of the antenna shown in the schematic diagram 4 according to an embodiment of the present invention.

To help understand how the antenna produces the second resonance frequency f2, FIG. 7 is a schematic plane diagram of the antenna in FIGS. 6. A, C, D, E, and F in FIG. 7 represent the first radiator 2, C and B represent the second radiator 5, C1 represents the first capacitor structure 3, and a white part represents the printed circuit board 1.

Figure 8:
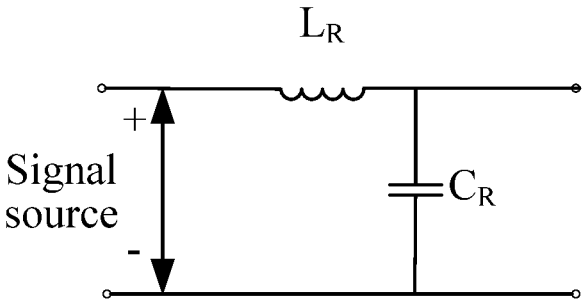
FIG. 8 is a schematic diagram of an equivalent circuit of a second radiator in the antenna shown in the schematic diagram 4 according to an embodiment of the present invention.

Specifically, the second radiator 5, the signal feed end 11, and the ground end 12 form the second antenna P2, and a diagram of an equivalent circuit of the second antenna is shown in FIG. 8 and conforms to a right hand transmission line (Right Hand Transmission Line) structure. The second radiator 5 is equivalent to a serially connected inductor LR relative to a signal source, and the first capacitor structure 3 is equivalent to a shunt capacitor CR relative to the signal source, so as to produce the second resonance frequency f2. The second resonance frequency f2 may cover 1700 MHz to 2170 MHz.

Further, an electrical length of the second radiator 5 is a quarter of a wavelength corresponding to the second resonance frequency f2.

Figure 9:
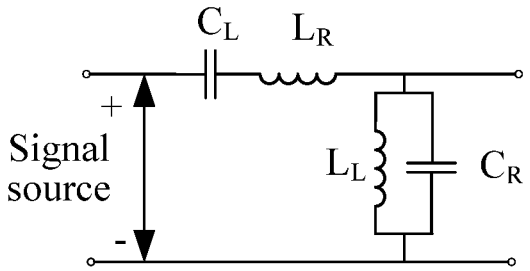
FIG. 9 is a schematic diagram of an equivalent circuit of the antenna shown in the schematic diagram 4 according to an embodiment of the present invention.

For the antenna shown in FIG. 6 whose equivalent circuit diagram of the first radiator 2, the second radiator 5, the first capacitor structure 3, the signal feed end 11, and the ground end 12 is shown in FIG. 9 forms a composite right hand and left hand transmission line (Composite Right Hand and Left Hand Transmission Line, CRLH TL for short) structure. The first radiator 2 is equivalent to a shunt inductor LL relative to a signal source, the first capacitor structure 3 is equivalent to a serially connected capacitor CL relative to the signal source, the second radiator 5 is equivalent to a serially connected inductor LR relative to the signal source, a parasitic capacitor CR is formed between the second radiator 5 and the printed circuit board, the first radiator 2 and the first capacitor structure 3 produce the first resonance frequency f1 and a higher order mode of the first resonance frequency f1, the second radiator 5 produces the second resonance frequency f2, and the first resonance frequency f1, the higher order mode of the first resonance frequency f1, and the second resonance frequency f2 may cover 791 MHz to 821 MHz, GSM850 (824 MHz to 894 MHz), GSM900 (880 MHz to 960 MHz), and 1700 MHz to 2170 MHz.

Figure 10:
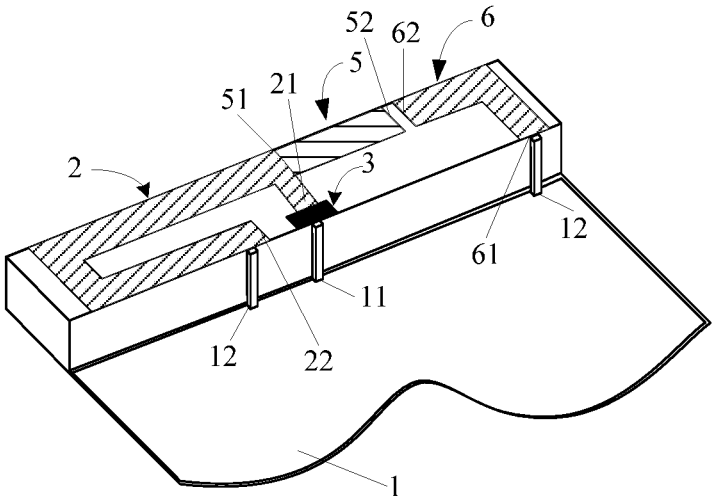
FIG. 10 is a schematic diagram 5 of an antenna according to an embodiment of the present invention.

Further, as shown in FIG. 10, the antenna further includes a parasitic branch 6, where one end 61 of the parasitic branch 6 is electrically connected to the ground end 12 of the printed circuit board 1, and another end 62 of the parasitic branch 6 and a second end 52 of the second radiator 5 are opposite and do not contact each other, so as to form coupling and produce a third resonance frequency f3.

The third resonance frequency f3 may cover 2270 MHz to 2800 MHz.

Figure 11:
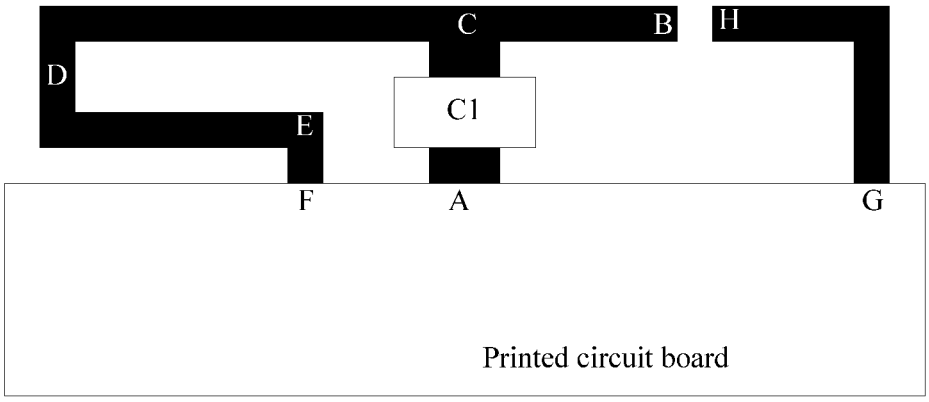
FIG. 11 is a schematic plane diagram of the antenna shown in the schematic diagram 5 according to an embodiment of the present invention.

To help understand how the antenna produces the third resonance frequency f3, FIG. 11 is a schematic plane diagram of the antenna in FIGS. 10. A, C, D, E, and F in FIG. 11 represent the first radiator 2, C and B represent the second radiator 5, H and G represent the parasitic branch 6, C1 represents the first capacitor structure 3, and a white part represents the printed circuit board 1.

It should be noted that, coverage of the second resonance frequency f2 produced by the second radiator 5 may be adjusted by changing the electrical length of the second radiator 5, or coverage of the third resonance frequency f3 produced by coupling between the parasitic branch 6 and the second radiator 5 by changing an electrical length of the parasitic branch 6. In summary, the higher order mode, produced by the first radiator 2, of the first resonance frequency f1, the second resonance frequency f2 produced by the second radiator 5, and the third resonance frequency f3 produced by coupling between the parasitic branch 6 and the second radiator 5 are used for covering a high-frequency resonance frequency band of 1700 MHz to 2800 MHz.

Optionally, the first capacitor structure 3 may be a common capacitor. The first capacitor structure 3 may include at least one capacitor connected in series or parallel in multiple forms (which may be also referred to as a capacitor build-up component), and the first capacitor structure 3 may also include an E-shape component and a U-shape component, where the E-shape component includes a first branch, a second branch, a third branch, and a fourth branch, where the first branch and the third branch are connected to two ends of the fourth branch, the second branch is located between the first branch and the third branch, the second branch is connected to the fourth branch, there is a gap formed between the first branch and the second branch, and there is a gap formed between the second branch and the third branch; and the U-shape component includes two branches, where the two branches of the U-shape component are separately located in the two gaps of the E-shape component, and the E-shape component and the U-shape component do not contact each other.

Figure 12:
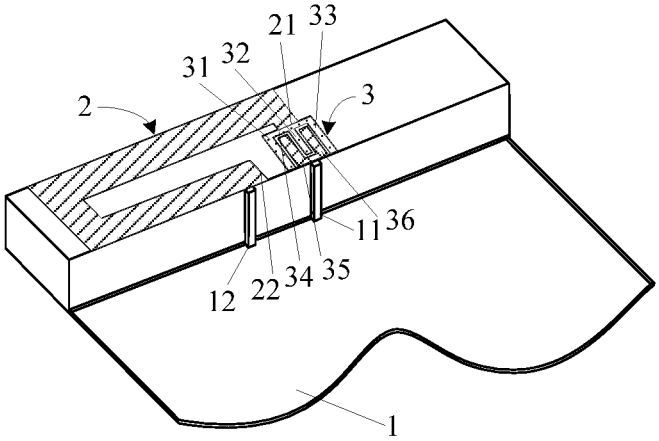
FIG. 12 is a schematic diagram 6 of an antenna according to an embodiment of the present invention.
Figure 13:
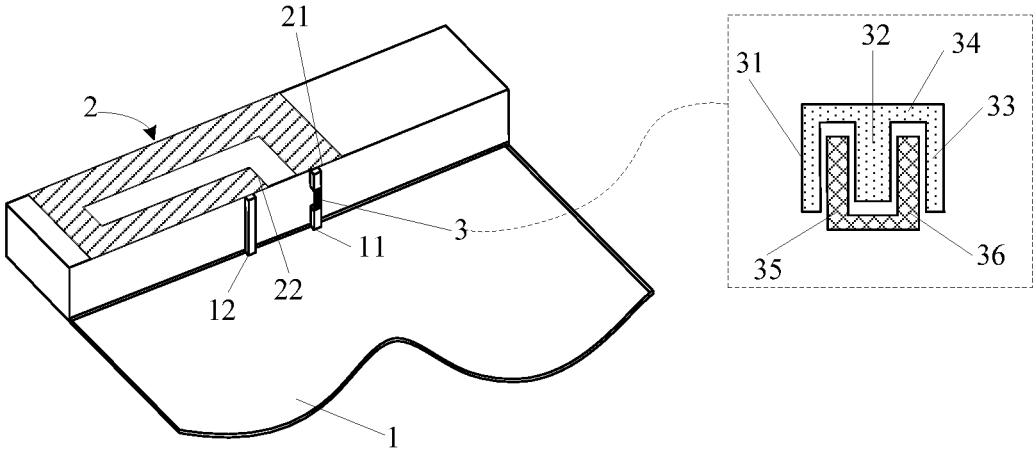
FIG. 13 is a schematic diagram 7 of an antenna according to an embodiment of the present invention.

As shown in FIG. 12 and FIG. 13, a part shown by using slants is the first radiator 2, a part shown by using dots is the E-shape component, and a part shown by using double slants is the U-shape component. The E-shape component includes a first branch 31, a second branch 32, a third branch 33, and a fourth branch 34, where the first branch 31 and the third branch 33 are connected to two ends of the fourth branch 34, the second branch 32 is located between the first branch 31 and the third branch 33, the second branch 32 is connected to the fourth branch 34, there is a gap formed between the first branch 31 and the second branch 32, and there is a gap formed between the second branch 32 and the third branch 33; and the U-shape component includes two branches, one branch 35 and the other branch 36, where the one branch 36 of the U-shape component is located in the gap formed between the first branch 31 and the second branch 32 of the E-shape component, and the other branch 36 of the U-shape component is located in the gap formed between the second branch 32 and the third branch 33 of the E-shape component; and the E-shape component and the U-shape component do not contact each other.

Optionally, when the first capacitor structure 3 includes the E-shape component and the U-shape component, the first end 21 of the first radiator 2 may be connected to the first branch 31 of the first capacitor structure 3, or the first end 21 of the first radiator 2 may be connected to the fourth branch 34 of the first capacitor structure 3.

Figure 14:
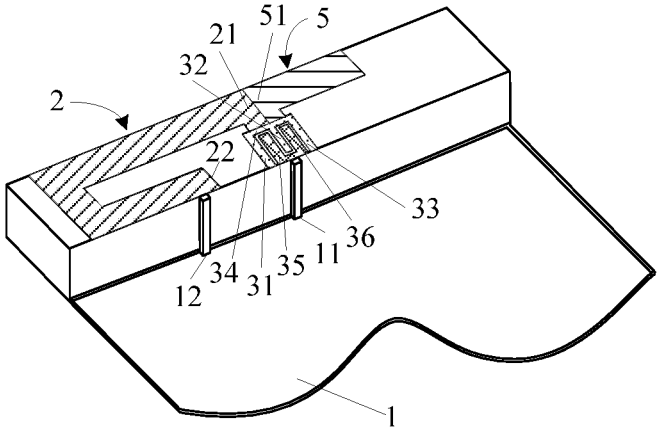
FIG. 14 is a schematic diagram 8 of an antenna according to an embodiment of the present invention.
Figure 15:
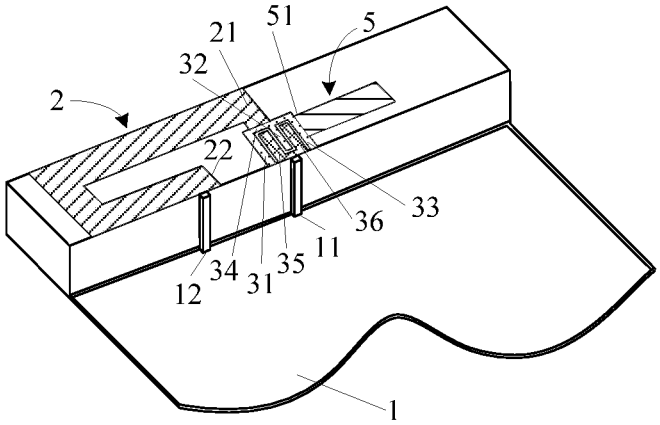
FIG. 15 is a schematic diagram 9 of an antenna according to an embodiment of the present invention.

Optionally, when the first capacitor structure 3 includes the E-shape component and the U-shape component, as shown in FIG. 14, the first end 51 of the second radiator 5 is connected to the fourth branch 34 of the first capacitor structure 2, or, as shown in FIG. 15, the first end 51 of the second radiator 5 is connected to the third branch 33 of the first capacitor structure 3.

Optionally, the second capacitor structure 4 may be a common capacitor. The second capacitor structure 4 may include at least one capacitor connected in series or parallel in multiple forms (which may be also referred to as a capacitor build-up component), and the first capacitor structure 4 may also include an E-shape component and a U-shape component, where the E-shape component includes a first branch, a second branch, a third branch, and a fourth branch, where the first branch and the third branch are connected to two ends of the fourth branch, the second branch is located between the first branch and the third branch, the second branch is connected to the fourth branch, there is a gap formed between the first branch and the second branch, and there is a gap formed between the second branch and the third branch; and the U-shape component includes two branches, where the two branches of the U-shape component are separately located in the two gaps of the E-shape component, and the E-shape component and the U-shape component do not contact each other.

Figure 16:
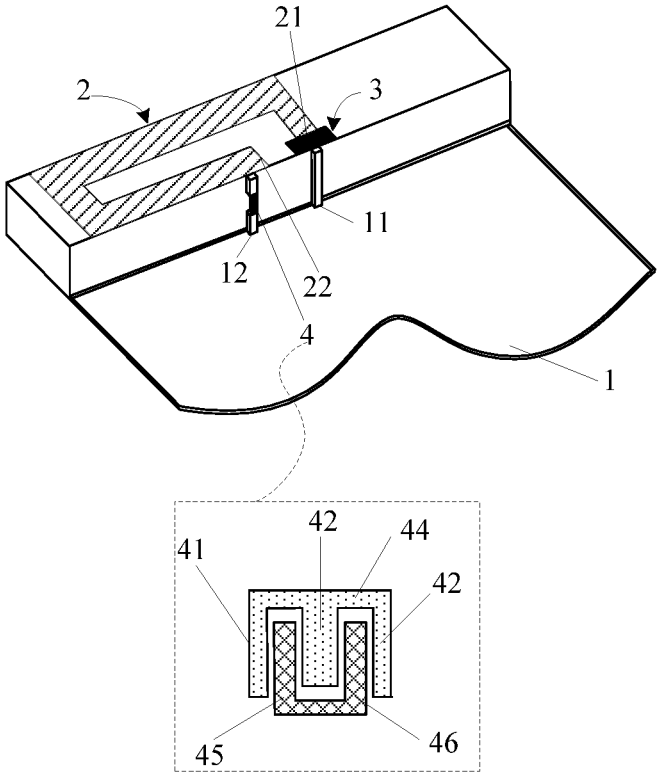
FIG. 16 is a schematic diagram 10 of an antenna according to an embodiment of the present invention.

As shown in FIG. 16, a part shown by using slants is the first radiator 2, and a part shown in black is the first capacitor structure 3. The second capacitor structure 4 includes the E-shape component and the U-shape component, where a part shown by using dots is the E-shape component, and a part shown by using double slants is the U-shape component. The E-shape component includes a first branch 41, a second branch 42, a third branch 43, and a fourth branch 44, where the first branch 41 and the third branch 43 are connected to two ends of the fourth branch 44, the second branch 42 is located between the first branch 41 and the third branch 43, the second branch 42 is connected to the fourth branch 44, there is a gap formed between the first branch 41 and the second branch 42, and there is a gap formed between the second branch 42 and the third branch 43; and the U-shape component includes two branches: one branch 45 and the other branch 46, where the one branch 45 of the U-shape component is located in the gap formed between the first branch 41 and the second branch 42 of the E-shape component, and the other branch 46 of the U-shape component is located in the gap formed between the second branch 42 and the third branch 43 of the E-shape component; and the E-shape component and the U-shape component do not contact each other.

It should be noted that, an M-shape component is also the E-shape component, that is, any structure including the first branch, the second branch, the third branch, and the fourth branch, where the first branch and the third branch are connected to two ends of the fourth branch, the second branch is located between the first branch and the third branch, the second branch is connected to the fourth branch, there is a gap formed between the first branch and the second branch, and there is a gap formed between the second branch and the third branch falls within the protection scope of this embodiment of the present invention; a V-shape component is also the U-shape component, that is, any component including two branches, where the two branches are separately located in the two gaps of the E-shape component falls within the protection scope of this embodiment of the present invention; and the E-shape component and the U-shape component do not contact each other. For ease of drawing and description, only the E-shape and the U-shape are shown in the accompanying drawings.

It should be noted that, when an antenna includes multiple radiators, different radiators of the antenna produce corresponding resonance frequencies. Generally, each radiator mainly transmits and receives the produced corresponding resonance frequency.

The first radiator 2 in the antenna mentioned in this embodiment is located on an antenna support, and a vertical distance between a plane on which the first radiator 2 is located and a plane on which the printed circuit board 1 is located may be between 2 millimeters and 6 millimeters. In this case, a clearance area may be designed for the antenna, so as to improve performance of the antenna and also implement design of a multiple-resonance-and-bandwidth antenna within relatively small space.

Optionally, the second radiator 5 and/or the parasitic branch 6 may be also located on the antenna support.

This embodiment of the present invention provides an antenna, where the antenna includes a first radiator and a first capacitor structure, where a first end of the first radiator is electrically connected to a signal feed end of the printed circuit board by means of the first capacitor structure, and a second end of the first radiator is electrically connected to a ground end of the printed circuit board; the first radiator, the first capacitor structure, the signal feed end, and the ground end form a first antenna configured to produce a first resonance frequency; and an electrical length of the first radiator is greater than one eighth of a wavelength corresponding to the first resonance frequency, and the electrical length of the first radiator is less than a quarter of the wavelength corresponding to the first resonance frequency, so as to implement design of an antenna with multiple resonance frequencies within relatively small space.

Embodiment 2

For the antenna in Embodiment 1, in this embodiment of the present invention, an emulation antenna model is established, and emulation and actual tests are performed.

Figure 17:
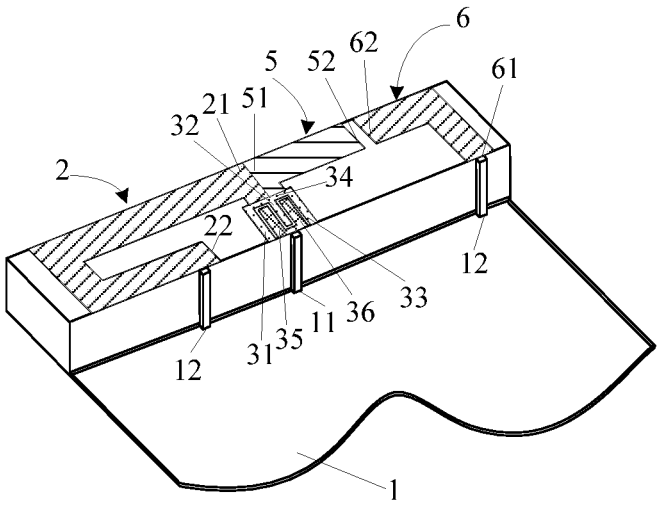
FIG. 17 is a schematic diagram 11 of an antenna according to an embodiment of the present invention.

As shown in FIG. 17, a part shown by using left slants is the first radiator 2, a pall shown by using right slants is the second radiator 5, and a part shown by using left slants is the parasitic branch 6. The first capacitor structure 3 includes the E-shape component and the U-shape component, where a part shown by using dots is the E-shape component, and a part shown by using double slants is the U-shape component.

Figure 18:
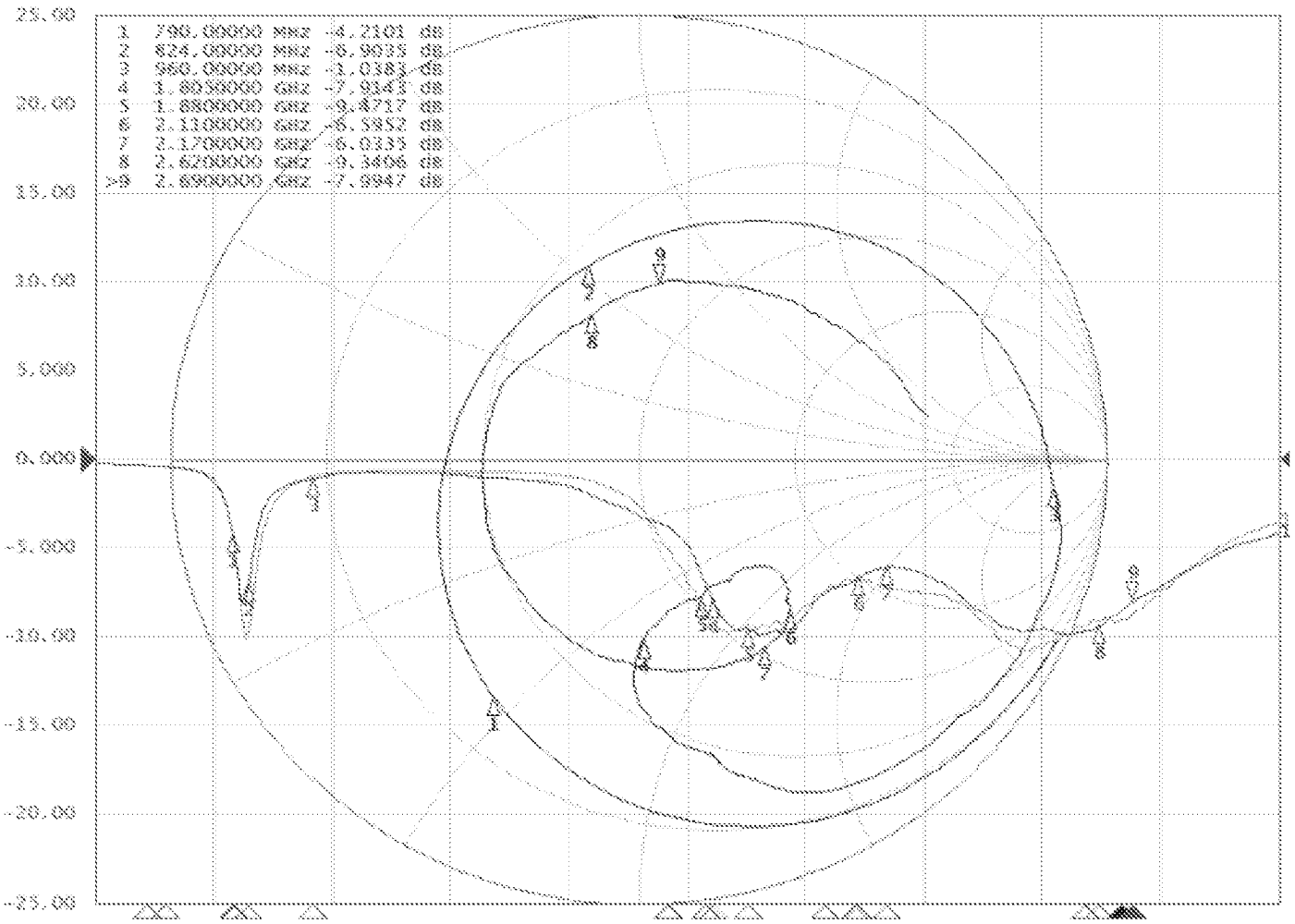
FIG. 18 is a diagram of a frequency response return loss of the antenna shown in the schematic diagram 11 according to an embodiment of the present invention.

FIG. 18 is a diagram of a frequency response return loss of an actual test on the antenna established in FIG. 17. Triangles in FIG. 18 mark resonance frequencies that can be produced by the antenna. The resonance frequency produced by using the first radiator 2, the first capacitor structure 3, and the second radiator 5 covers 791 MHz to 821 MHz and 1700 MHz to 2170 MHz, and in addition, the resonance frequency produced by coupling between the second radiator 5 and the parasitic branch 6 is 2270 MHz to 2800 MHz, and therefore, a final resonance frequency of the entire antenna may cover 791 MHz to 821 MHz and 1700 MHz to 2800 MHz.

Figure 19:
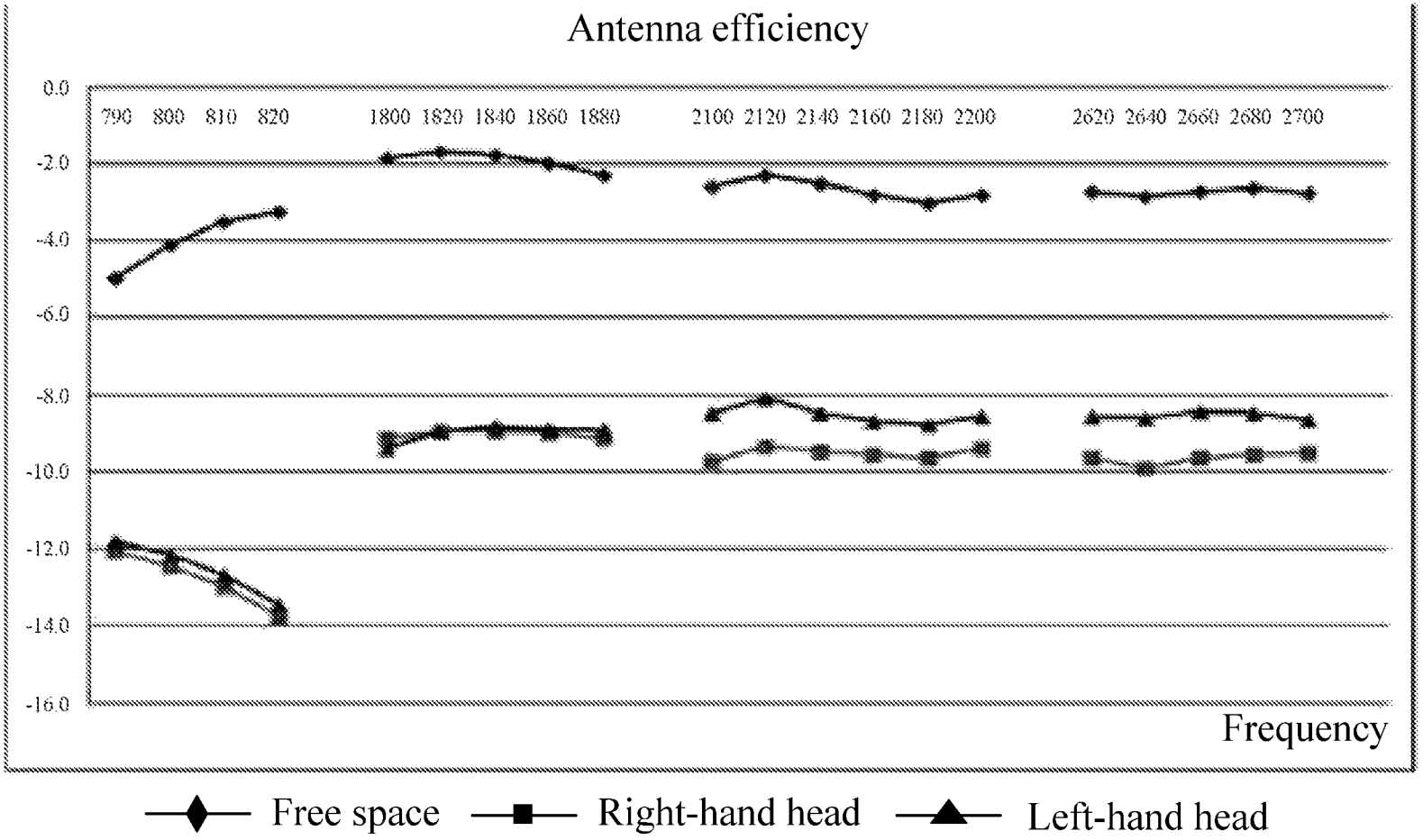
FIG. 19 is a diagram of antenna efficiency of the antenna shown in the schematic diagram 11 according to an embodiment of the present invention.

FIG. 19 is a diagram of antenna frequency-efficiency obtained by performing an actual test on the antenna provided in FIG. 17. A horizontal coordinate is frequency whose unit is gigahertz (MHz); a vertical coordinate is antenna efficiency whose unit is decibel (dB); a solid line with rhombuses is a curve of antenna frequency-efficiency obtained by performing a test in a free space mode, a solid line with squares is a curve of antenna frequency-efficiency obtained by performing a test in a right hand head mode, and a solid line with triangles is a curve of antenna frequency-efficiency obtained by performing a test in a left hand head mode. A result of the actual test in FIG. 18 indicates that, the resonance frequency produced by the antenna may cover 791 MHz to 821 MHz and 1700 MHz to 2800 MHz.

Figure 20:
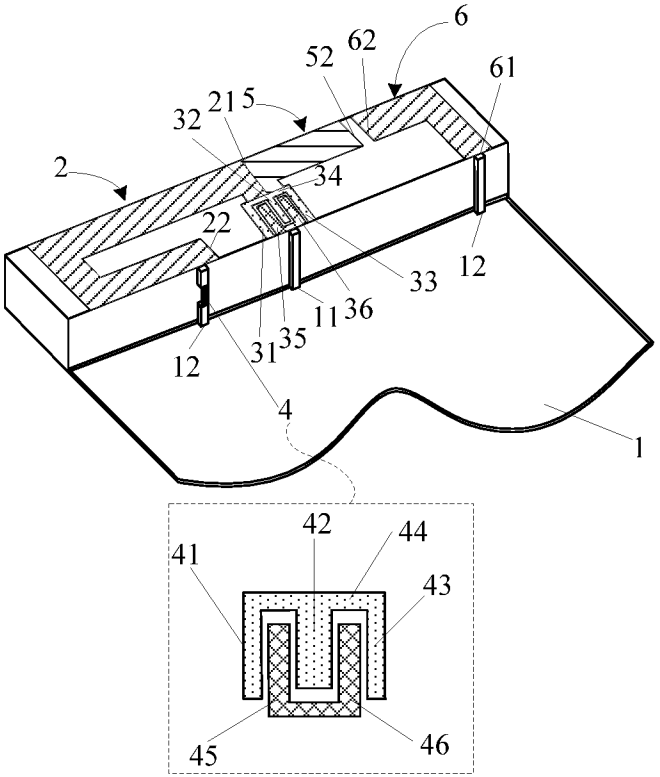
FIG. 20 is a schematic diagram 12 of an antenna according to an embodiment of the present invention.

Further, when a second end 21 of the first radiator 2 in FIG. 17 is electrically connected to a ground end 12 of the printed circuit board 1 by means of a second capacitor structure 4, the second capacitor structure includes the E-shape component and the U-shape component, where a part shown by using dots is the E-shape component, and a part shown by using double slants is the U-shape component, as shown in FIG. 20.

Figure 21:
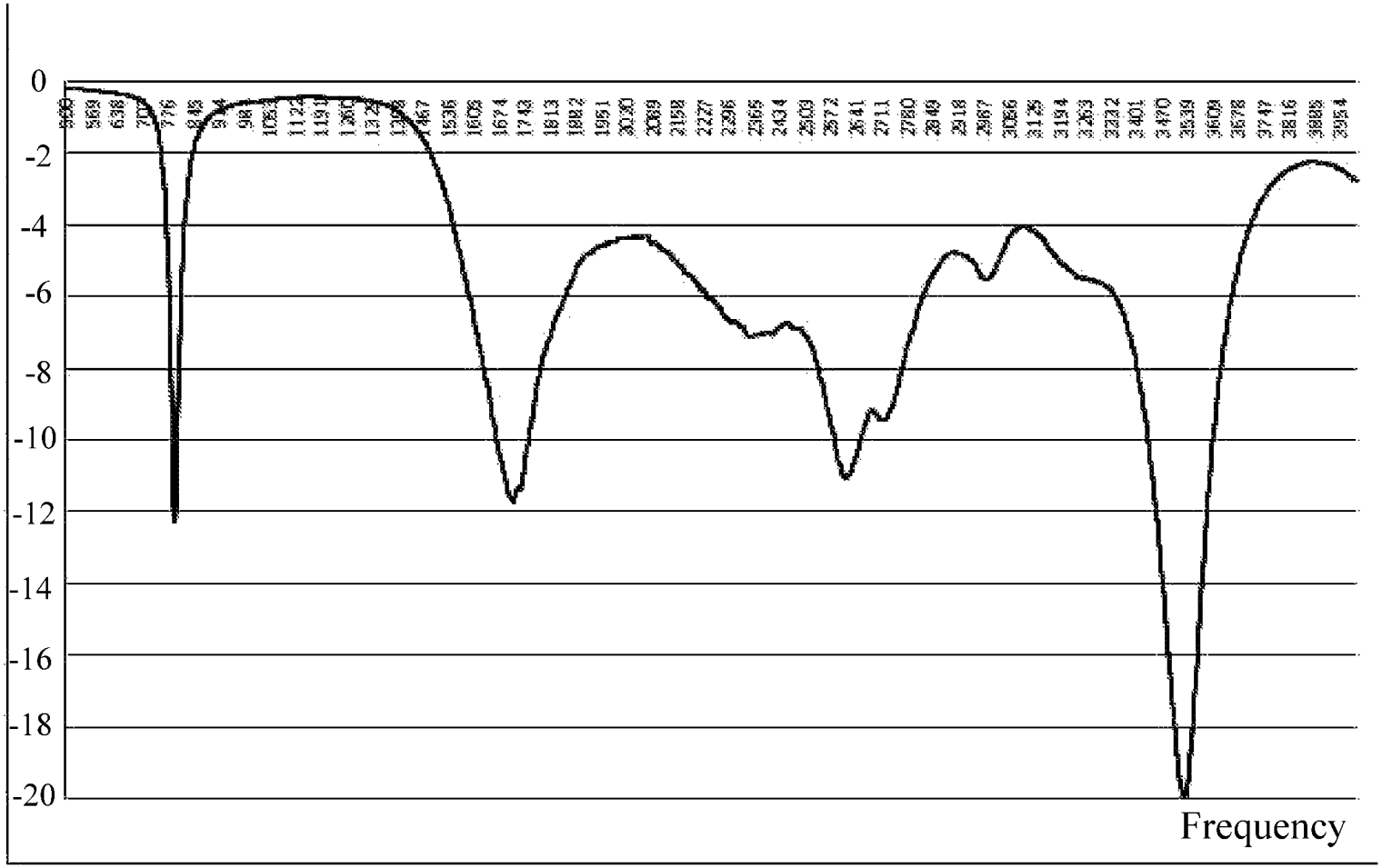
FIG. 21 is a diagram of a frequency response return loss of the antenna shown in the schematic diagram 12 according to an embodiment of the present invention.
Figure 22:
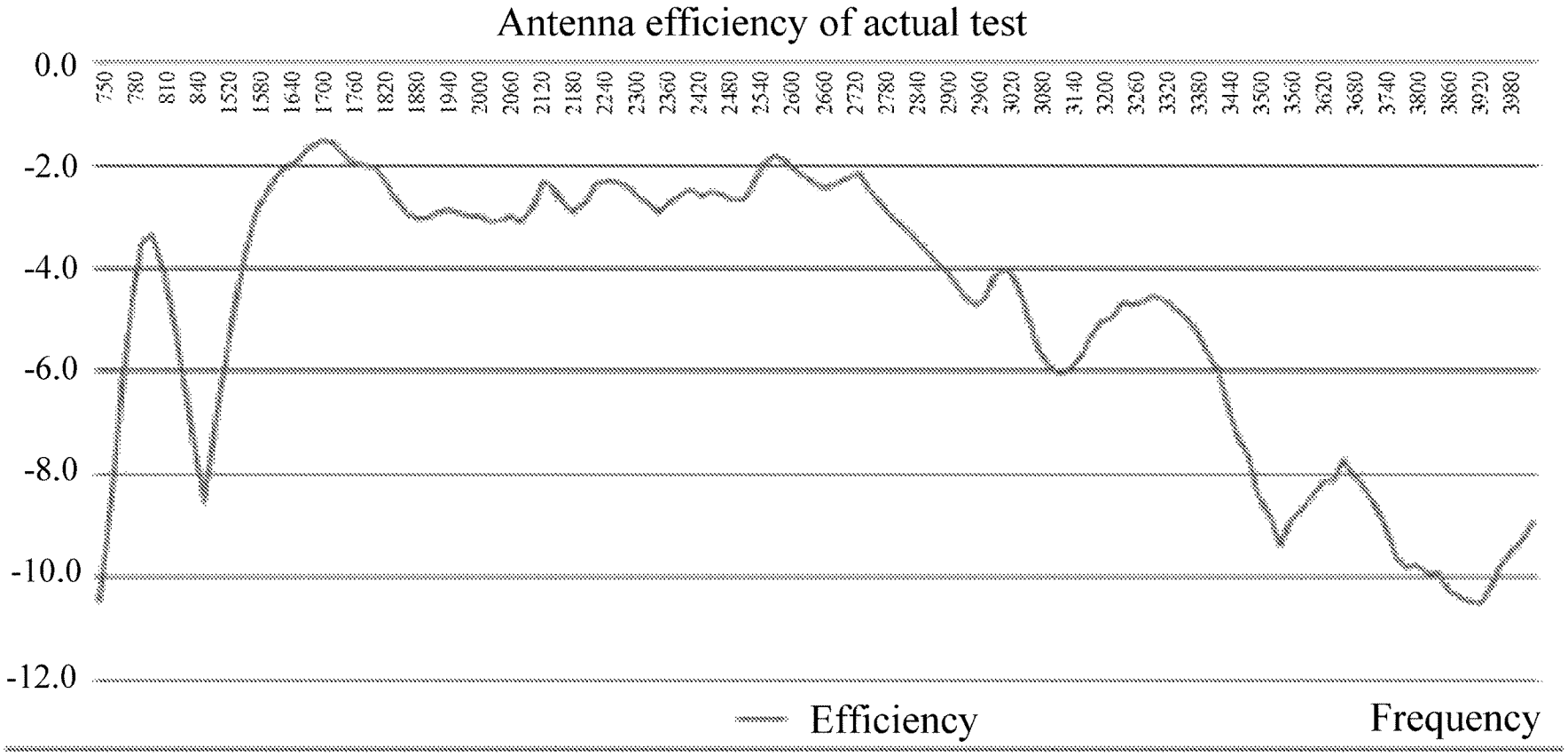
FIG. 22 is a diagram of antenna efficiency of the antenna shown in the schematic diagram 12 according to an embodiment of the present invention.

It is assumed that a value of the second capacitor structure is 8.2 pF. FIG. 21 is a diagram of a frequency response return loss of the antenna shown in FIG. 20, and FIG. 22 is a diagram of antenna efficiency of an actual test on the antenna shown in FIG. 20, where a horizontal coordinate represents frequency (whose unit is MHz), and a vertical coordinate represents antenna efficiency (whose unit is dB). Test results of FIG. 21 and FIG. 22 indicated that, after the ground point 12 is connected to an 8.2 pF capacitor in series, a resonance frequency of the entire antenna may cover 780 MHz to 820 MHz and 1520 MHz to 3000 MHz.

This embodiment of the present invention provides an antenna, where the antenna includes a first radiator and a first capacitor structure, where a first end of the first radiator is electrically connected to a signal feed end of the printed circuit board by means of the first capacitor structure, and a second end of the first radiator is electrically connected to a ground end of the printed circuit board; the first radiator, the first capacitor structure, the signal feed end, and the ground end form a first antenna configured to produce a first resonance frequency; and an electrical length of the first radiator is greater than one eighth of a wavelength corresponding to the first resonance frequency, and the electrical length of the first radiator is less than a quarter of the wavelength corresponding to the first resonance frequency, so as to implement design of an antenna with multiple resonance frequencies within relatively small space. Moreover, the antenna further includes a second radiator and a parasitic branch, so as to cover a wider resonance frequency, and further widen, by using a second capacitor structure, a high-frequency bandwidth.

Embodiment 3

Figure 23:
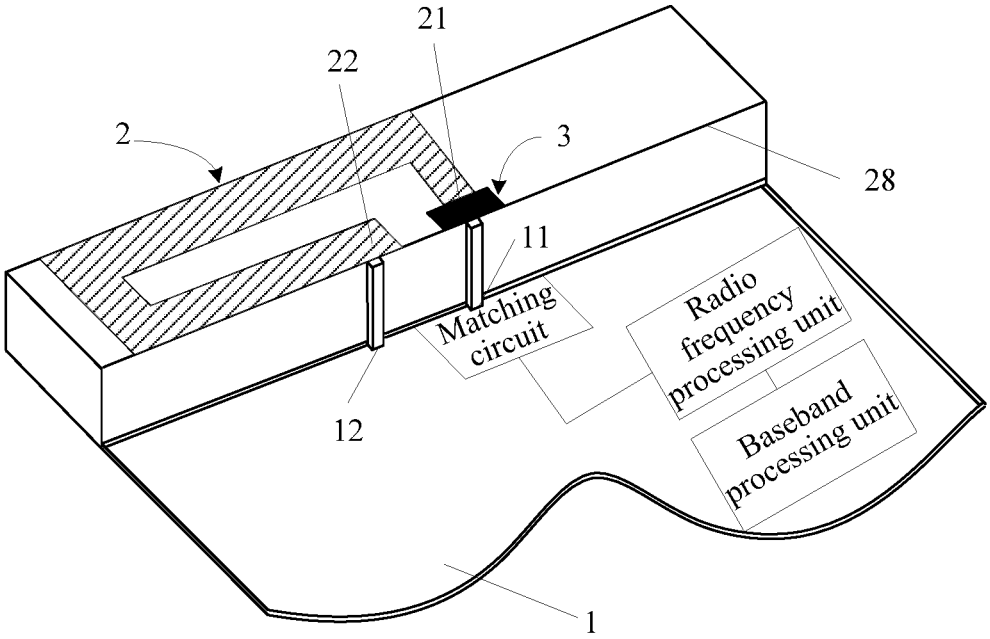
FIG. 23 is a mobile terminal according to an embodiment of the present invention.

This embodiment of the present invention provides a mobile terminal. As shown in FIG. 23, the mobile terminal includes a radio frequency processing unit, a baseband processing unit, and an antenna, where the antenna includes a first radiator 2 and a first capacitor structure 3, where a first end 21 of the first radiator 2 is electrically connected to a signal feed end 11 of the printed circuit board 1 by means of the first capacitor structure 3, and a second end 22 of the first radiator 2 is electrically connected to a ground end 12 of the printed circuit board 1; the first radiator 2, the first capacitor structure 3, the signal feed end 11, and the ground end 12 form a first antenna configured to produce a first resonance frequency f1; and an electrical length of the first radiator 2 is greater than one eighth of a wavelength corresponding to the first resonance frequency f1, and the electrical length of the first radiator 2 is less than a quarter of the wavelength corresponding to the first resonance frequency f1; the radio frequency processing unit is connected to the signal feed end 11 of the printed circuit board 1 by means of a matching circuit; and the antenna is configured to transmit a received radio signal to the radio frequency processing unit, or convert a transmit signal of the radio frequency processing unit into an electromagnetic wave and send the electromagnetic wave; the radio frequency processing unit is configured to perform frequency-selective, amplifying, and down-conversion processing on the radio signal received by the antenna, and convert the processed radio signal into an intermediate frequency signal or a baseband signal and send the intermediate frequency signal or the baseband signal to the baseband processing unit, or configured to send, by means of the antenna and by means of up-conversion and amplifying, a baseband signal or an intermediate frequency signal sent by the baseband processing unit; and the baseband processing unit processes the received intermediate frequency signal or baseband signal.

The matching circuit is configured to adjust impedance of the antenna, so that the impedance matches impedance of the radio frequency processing unit, so as to produce a resonance frequency meeting a requirement. The first resonance frequency f1 may cover 791 MHz to 821 MHz, GSM850 (824 MHz to 894 MHz), and GSM900 (880 MHz to 960 MHz).

Further, because the electrical length of the first radiator 2 is greater than one eighth of the wavelength corresponding to the first resonance frequency f1, and the electrical length of the first radiator 2 is less than a quarter of the wavelength corresponding to the first resonance frequency f1, the first antenna P1 further produces a high-order harmonic wave of the first resonance frequency f1 (which is also referred to as frequency multiplication of the first resonance frequency f1), where coverage of the high-order harmonic wave is 1700 MHz to 1800 MHz. Therefore, the first radiator 2, the first capacitor structure 3, the signal feed end 11, and the ground end 12 form the first antenna P1, so that a frequency range covering the first resonance frequency f1 and the high-order harmonic wave of the first resonance frequency f1 can be produced within relatively small space.

It should be noted that, the first radiator 2 is located on an antenna support 28, and a vertical distance between a plane on which the first radiator 2 is located and a plane on which the printed circuit board 1 is located may be between 2 millimeters and 6 millimeters. In this case, a clearance area may be designed for the antenna, so as to improve performance of the antenna and also implement design of a multiple-resonance-and-bandwidth antenna within relatively small space.

Figure 24:
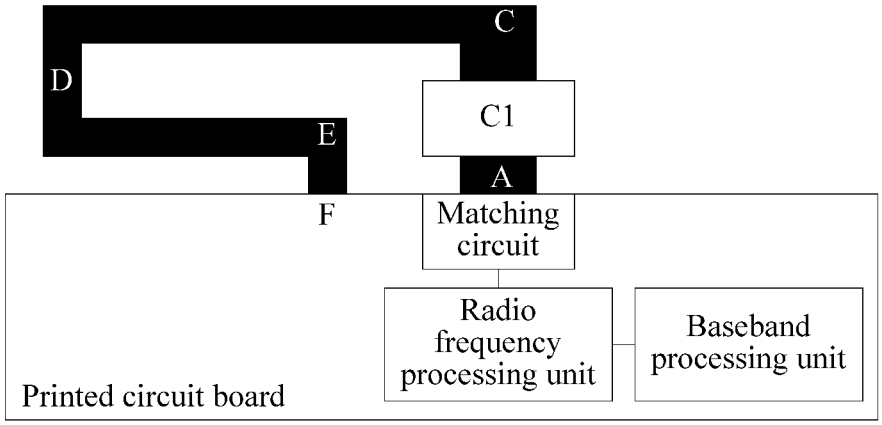
FIG. 24 is a schematic plane diagram of a mobile terminal according to an embodiment of the present invention.

FIG. 24 is a schematic plane diagram of the mobile terminal shown in FIGS. 23. A, C, D, E, and F represent the first radiator 2, C1 represents the first capacitor structure 3, A represents the signal feed end 11 of the printed circuit board 1, F represents the ground end 12 of the printed circuit board 1, and the matching circuit is electrically connected to the signal feed end 11 (that is, a point A) of the printed circuit board 1.

Certainly, the antenna described in this embodiment may also include any one of antenna structures described in Embodiment 1 and Embodiment 2, and for specific details, reference may be made to the antennas described in Embodiment 1 and Embodiment 2, which are not described herein again. The foregoing mobile terminal is a communications device used during movement, may be a mobile phone, or may be a tablet computer, a data card, or the like. Certainly, the mobile terminal is not limited to this.

Finally, it should be noted that the foregoing embodiments are merely intended for describing the technical solutions of the present invention but not for limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present invention.

What is claimed is:

1. An electronic device, comprising an antenna structure, wherein the antenna structure comprises:

a first radiator;

a first capacitor;

a second radiator; and a parasitic branch;

wherein a first end of the first radiator is electrically connected to a signal feed end of a printed circuit board by the first capacitor, and a second end of the first radiator is electrically connected to a first ground end of the printed circuit board, and wherein the first radiator, the first capacitor, the signal feed end, and the first ground end form a first antenna configured to generate a first resonance frequency;

wherein a first end of the second radiator is electrically connected to the first end of the first radiator, and wherein the second radiator, the first capacitor, and the signal feed end form a second antenna configured to generate a second resonance frequency, and an equivalent circuit of the first radiator, the second radiator, the first capacitor, the signal feed end, and the first ground end exhibits a characteristic of a composite right hand and left hand transmission line structure, wherein the first radiator is equivalent to a shunt inductor relative to a signal source, the first capacitor is equivalent to a serially connected capacitor relative to the signal source; and wherein a first end of the parasitic branch is electrically connected to a second ground end of the printed circuit board, and a second end of the parasitic branch and a second end of the second radiator are opposite to each other across a gap to form coupling across the gap, and the coupling is configured to cause the antenna structure to generate a third resonance frequency.

2. The electronic device according to claim 1, wherein the second radiator is equivalent to a serially connected inductor relative to the signal source, and a parasitic capacitor is equivalently formed between the second radiator and the printed circuit board.

3. The electronic device according to claim 1, wherein the first resonance frequency is in a frequency range of:

791 MHz to 821 MHz;

824 MHz to 894 MHz; or

880 MHz to 960 MHz.

4. The electronic device according to claim 1, wherein the second resonance frequency is in a frequency range of 1700 MHz-2170 MHz.

5. The electronic device according to claim 1, wherein the third resonance frequency is in a frequency range of 2270 MHz-2800 MHz.

6. The electronic device according to claim 1, wherein the first antenna is further configured to produce a high-order harmonic wave of the first resonance frequency.

7. The electronic device according to claim 1, wherein the second radiator is located entirely on a first side of the gap, and the parasitic branch is located entirely on a second side of the gap that is opposite to the first side across the gap.

8. The electronic device according to claim 7, wherein a virtual straight line that extends along a major axis of the second radiator, extends along a portion of the parasitic branch, and passes through the gap.

9. The electronic device according to claim 7, wherein a virtual straight line that extends along a major axis of the second radiator, extends along a portion of the first radiator.

10. The electronic device according to claim 7, wherein a virtual straight line extends along a major axis of the second radiator, a major axis of the first radiator, a major axis of the parasitic branch, and passes through the gap.

11. The electronic device according to claim 1, wherein the second end of the parasitic branch and the second end of the second radiator are coupled using electric coupling.

12. The electronic device according to claim 1, wherein the first capacitor is disposed in a circuit path directly connected to the first radiator and the second radiator.

13. The electronic device according to claim 1, wherein an electrical length of the first radiator is greater than one eighth and less than a quarter of a wavelength corresponding to the first resonance frequency.

14. An electronic device, comprising an antenna structure, wherein the antenna structure comprises:

a first radiator;

a first capacitor;

a second radiator; and a parasitic branch;

wherein a first end of the first radiator is electrically connected to a signal feed end of a printed circuit board by the first capacitor, and a second end of the first radiator is electrically connected to a first ground end of the printed circuit board, and wherein the first radiator, the first capacitor, the signal feed end, and the first ground end form a first antenna;

wherein a first end of the second radiator is electrically connected to the first end of the first radiator, and an equivalent circuit of the first radiator, the second radiator, the first capacitor, the signal feed end, and the first ground end exhibits a characteristic of a composite right hand and left hand transmission line structure, wherein the first radiator is equivalent to a shunt inductor relative to a signal source, the first capacitor is equivalent to a serially connected capacitor relative to the signal source; and wherein a first end of the parasitic branch is electrically connected to a second ground end of the printed circuit board, and a second end of the parasitic branch and a second end of the second radiator are opposite to each other across a gap to form coupling across the gap.

15. The electronic device according to claim 14, wherein the second radiator is equivalent to a serially connected inductor relative to the signal source, and a parasitic capacitor is equivalently formed between the second radiator and the printed circuit board.

16. The electronic device according to claim 14, wherein the antenna structure is configured to generate a first resonance frequency, a second resonance frequency, and a third resonance frequency.

17. The electronic device according to claim 14, wherein the second radiator is located entirely on a first side of the gap, and the parasitic branch is located entirely on a second side of the gap that is opposite the first side across the gap.

18. The electronic device according to claim 17, wherein a virtual straight line that extends along a major axis of the second radiator, extends along at least one of the following:

a portion of the first radiator; or a portion of the parasitic branch, and passes through the gap.

19. The electronic device according to claim 14, wherein the first capacitor is disposed in a circuit path directly connected to the first radiator and the second radiator.

20. The electronic device according to claim 16, wherein an electrical length of the first radiator is greater than one eighth and less than a quarter of a wavelength corresponding to the first resonance frequency.

* * * * *